US005782567A

United States Patent [19]

Endo

[11] Patent Number: 5,782,567

[45] Date of Patent: Jul. 21, 1998

[54] PRINTING APPARATUS COMPRISING PLURAL PRINTING MECHANISMS

[75] Inventor: Katsuyuki Endo, Suwa, Japan

[73] Assignee: Seiko Epson Corporation, Tokyo, Japan

[21] Appl. No.: 785,063

[22] Filed: Jan. 17, 1997

[30] Foreign Application Priority Data

Jan. 19, 1996 [JP] Japan ..... 8-007212

[51] Int. Cl.[6] ..... B41J 15/22; B41J 11/00

[52] U.S. Cl. ..... 400/621; 400/611

[58] Field of Search ..... 400/621, 611

[56] References Cited

U.S. PATENT DOCUMENTS

| | | | |
|---|---|---|---|
| 3,901,372 | 8/1975 | Denley | 400/690.1 |
| 4,142,235 | 2/1979 | Tadakuma et al. | 395/224 |
| 4,562,444 | 12/1985 | Nagashima et al. | 400/624 |
| 4,614,949 | 9/1986 | Hakkaku et al. | 400/246 |
| 4,747,707 | 5/1988 | Komori | 400/613 |
| 5,000,598 | 3/1991 | Jingu et al. | 400/642 |
| 5,238,198 | 8/1993 | Jingu et al. | 400/613 |
| 5,302,037 | 4/1994 | Schoendienst et al. | 400/621 |

FOREIGN PATENT DOCUMENTS

| | | |
|---|---|---|
| 715282 | 6/1996 | European Pat. Off. . |
| 2-95645 | 4/1990 | Japan . |
| 2-299869 | 12/1990 | Japan . |
| 5-12863 | 4/1993 | Japan . |
| 5-124278 | 5/1993 | Japan . |
| 5-250564 | 9/1993 | Japan . |
| 6-312524 | 11/1994 | Japan . |
| 2145399 | 3/1985 | United Kingdom . |

*Primary Examiner*—Edgar S. Burr
*Assistant Examiner*—Daniel J. Colilla
*Attorney, Agent, or Firm*—Mark P. Watson

[57] ABSTRACT

A compact printing apparatus having both receipt printing and journal printing capabilities is provided in a configuration enabling POS stations equipped with a personal computer, display, and cash drawer to be assembled with good space utilization efficiency for installation in places with minimal space availability. A receipt printing mechanism 10, receipt paper housing 17 for receipt printing roll paper 11, journal printing mechanism 20, roll paper housing 27 for journal printing roll paper 21, and take-up reel housing 29 for take-up reel 22 onto which printed journal paper is taken up are arranged in line from front 6a to back 6c of printer 5. This arrangement enables part of the paper path of the printed journal paper to be viewed from outside the printer housing. This in-line arrangement also prevents wasted space inside printer 5, and achieves a narrow, compact, high reliability printer whereby the result of journal printing can be visually confirmed from outside the printer. The planar arrangement of these components also enhances the good maintenance and operation characteristics of the printer.

14 Claims, 7 Drawing Sheets

PRINTING APPARATUS COMPRISING PLURAL PRINTING MECHANISMS

BACKGROUND OF THE INVENTION

1. Field of the Invention

The present invention relates to a printing apparatus comprising plural printing means for executing independent printing processes such as receipt printing and journal printing. Such printing apparatus is particularly suited for use with a point-of-sale (POS) station or similar information processing station.

2. Description of the Related Art

Many POS stations in use today are assembled using a personal computer, display, cash drawer, printer, check reader, and other appropriate peripheral devices in a size suited to the scale of the store or check-out area or to meet the specific requirements of the counter arrangement and installation area. The printers used in such POS stations are commonly multiple function printers providing two printing functions, a receipt printing function for printing the receipts handed to customers, and a journal printing function for printing the sales journal retained by the store. FIG. 7 is an illustration of a typical POS station printer enabling both receipt printing and journal printing.

The printer 1 shown in this example comprises a receipt printing mechanism 10 for printing receipts, and a journal printing mechanism 20 for journal printing. Note that the receipt printing mechanism 10 and journal printing mechanism 20 are disposed horizontally in series (ie., side by side). The roll paper 11 for receipt printing is disposed toward the back of the printer 1 from the receipt printing mechanism 10 such that receipt paper from the roll paper 11 is supplied to the receipt printing mechanism 10, the receipt is printed, and the roll paper receipt is then fed outside the printer 1 from the paper exit 2.

The roll paper 21 for journal printing is likewise disposed toward the back of the printer 1 from the journal printing mechanism 20, and a take-up reel 22 for winding and holding the printed journal paper is housed further behind the roll paper 21. After the journal paper is fed from the roll paper 21 to the journal printing mechanism 20 and printed, the paper is guided again toward the back of the printer 1 and taken up on the take-up reel 22.

In more recent years such POS stations have even been introduced to very small retail establishments and other small-scale sales sites where the area that can be allocated to a POS station is extremely limited. This makes it necessary to reduce the size of every component in the POS station and combine plural component devices to minimize wasted space. At the same time, however, each of the components in the POS station must be constructed to assure easy operation and use, and to prevent operating errors. Repair must also be simple when a problem occurs so that store operations are not adversely affected.

The POS station printer 1 shown in FIG. 7 is a multiple function printer combining both receipt and journal printing capabilities, thereby making it possible to reduce the number of devices constituting the complete POS station and thus greatly reducing the total required installation area. When the need to construct POS stations for installation in even more confined areas is considered, however, the printer 1 shown in FIG. 7 does not meet the requirements of an extremely space-efficient design.

More specifically, the horizontal arrangement of the receipt printing mechanism 10 and the journal printing mechanism 20 in the printer 1 shown in FIG. 7 results in a squarish configuration. This makes it difficult, for example, to place the printer 1 on top of the cash drawer beside the personal computer or display, thus creating wasted space in the POS station arrangement. Space utilization inside the printer 1 is also poor because while the roll paper 21 and take-up reel 22 are arrayed behind the journal printing mechanism 20, only a single roll paper 11 is placed behind the receipt printing mechanism 10, resulting in dead space behind the receipt printing mechanism 10 beside the take-up reel 22.

Furthermore, if roll paper 11 and roll paper 21 are placed side by side inside the printer 1, the paper width itself must be reduced if the width of the printer 1 is to be reduced. This accordingly reduces the number of printable columns on each roll, thus limiting the printable information and transaction detail, including the item names, price information, store name, logo, service information, and receipt information. More specifically, the content and expressiveness of the printed information becomes limited.

To resolve these problems a printer in which the receipt printing mechanism and journal printing mechanism are arrayed vertically in-line has been previously proposed in Japanese utility model patent laid-open number 12863/93.

With such printer, however, the journal printing mechanism is disposed below the roll paper for receipt printing, and the journal paper transportation path does not pass a position from which the journal paper can be made visible to the user. It is therefore not possible for the user to confirm the result of printing on the journal paper as printing is in progress or immediately after printing. This means that printing data for the next customer may begin even though the journal entry for the preceding customer was incorrectly printed, and the journal entries, the primary purpose of which is to provide a back-up proof copy for the store, may not be very useful.

OBJECTS OF THE INVENTION

Therefore, an object of the present invention is to resolve the above problems by providing a printing apparatus that can be further reduced in size while still providing both receipt printing and journal printing capabilities, thus efficiently utilizing confined spaces for POS station construction while enabling the user to reliably confirm journal printing content as printing proceeds. A further object of the present invention is to provide a printing apparatus requiring less installation space while retaining good operability and maintenance characteristics.

SUMMARY OF THE INVENTION

To achieve the above objects, the two printing mechanisms and the spaces for storing the recording media supplied to both printing mechanisms are arranged in a substantially in-line arrangement one behind the other, thereby achieving a long, narrow-bodied printing apparatus that also enables the user to confirm printing results before the printed media is stored. This high reliability printing apparatus can then be assembled with a personal computer, for example, on the cash drawer, or can be placed in extra space around the POS station.

More specifically, a printing apparatus according to the present invention comprises first and second printing mechanisms for printing to first and second recording media respectively wherein the first and second printing mechanisms are disposed longitudinally in-line; a recording media storage section for storing the first recording medium printed by the first printing mechanism; a recording medium path that connects the first printing mechanism to the recording media storage section and is traveled by the first recording medium, and a recording medium exposure section disposed above the recording medium path to expose and make visible information printed on the recording media.

In the printing apparatus at least one of the first and second recording media is preferably a roll paper medium, in which case at least one of the roll paper media is positioned substantially in-line between the first and second printing mechanisms. This makes it possible to locate the recording medium path of the recording medium that is output from the first printing mechanism near the recording medium exposure section, thereby enabling the operator to confirm the information printed on the first recording media.

The first printing mechanism of the printing apparatus preferably comprises a printing section comprising a print head and a platen opposing the print head with the recording medium disposed therebetween, and a printing section opening mechanism for opening and closing the printing section by moving at least one of the print head and platen relative to each other wherein the printing section opening mechanism is operable when the roll paper disposed between the first and second printing mechanisms is removed.

This printing section opening mechanism thus makes it possible to easily remove pieces of the recording medium that may be jammed or left in the printing section, namely between the print head and platen.

Alternatively when the first recording medium is a roll paper medium, the first recording medium, the first printing mechanism, and the recording media storage section are preferably arrayed in a substantially in-line arrangement. In addition, when the second recording medium is a roll paper medium, at least one of the first and second recording media is preferably disposed between the first and second printing mechanisms, and the first and second recording media and the first and second printing mechanisms are arrayed in a substantially in-line arrangement.

This makes it possible to locate the recording medium path of the recording medium that is output from the first printing mechanism near the recording medium exposure section, thereby enabling the operator to confirm the printed results.

In addition to the above, the printing apparatus of the present invention preferably comprises a housing for enclosing at least the recording media, the printing mechanisms, the recording media storage section, and the recording medium path, and a first cover disposed to enable opening and closing on the housing such that when the first cover is open at least the recording media, the printing mechanisms, the recording media storage section, and the recording medium path are exposed.

By opening the first cover, all of the components necessary for maintaining the printing apparatus can be exposed. Note, also, that the recording medium exposure section is preferably an opening in the first cover, thereby improving the visibility of the recording medium through the recording medium exposure section.

When the second recording medium is a roll paper medium in the preceding printing apparatus, the printing apparatus further comprises a cutter housed in the housing for cutting the second recording medium, and a second cover disposed to enable opening and closing on the housing such that when the second cover is open the cutting means is exposed. This makes it possible to easily remove pieces of the recording medium that may be jammed or left in the cutter.

In the above printing apparatus the second recording medium is preferably disposed substantially in-line between the first and second printing mechanisms. The cutter is also preferably disposed in a manner enabling the cutting means to open and close when the second cover is open, and when the cutter is open, the second printing mechanism is exposed. This arrangement makes it possible to maintain the second printing mechanism from the front of the printing apparatus.

The second printing mechanism also preferably comprises a printing section comprising a print head and platen opposing the print head with the recording medium disposed therebetween, and a printing section opening mechanism for opening and closing the printing section by moving at least one of the print head and platen relative to the other, and the printing section opening mechanism is preferably operable when the second printing mechanism is exposed.

This printing section opening mechanism thus makes it possible to easily remove pieces of the recording medium that may be jammed or left between the print head and platen.

In addition to the above, the first and second printing mechanisms of the printing apparatus according to the present invention preferably comprise at least a base frame, a print head supported on the base frame, a platen supported on the base frame opposing the print head with the recording medium disposed therebetween, and a transport mechanism supported on the base frame for transporting the recording medium past the print head. The printing apparatus is characterized by the first and second printing mechanisms being arranged in the printing apparatus with the base frame maintained substantially perpendicular.

The printing mechanisms can therefore be of reduced length as provided in the printing apparatus, and the front-to-back length of the printing apparatus can be shortened.

The first printing mechanism of this printing apparatus is also preferably disposed at a position higher than the second printing mechanism, thereby improving the visibility of the recording medium exposure section disposed above the path of the recording medium that is output from the first printing mechanism.

The first and second printing mechanisms of the printing apparatus according to the present invention are also preferably interchangeable. Interchangeability assures that both first and second printing mechanisms are operated and maintained in the same manner and use the same component parts, and thus provides the end-user with significant practical benefits.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

A preferred embodiment of the present invention is described below based on the accompanying figures.

Figure 1:
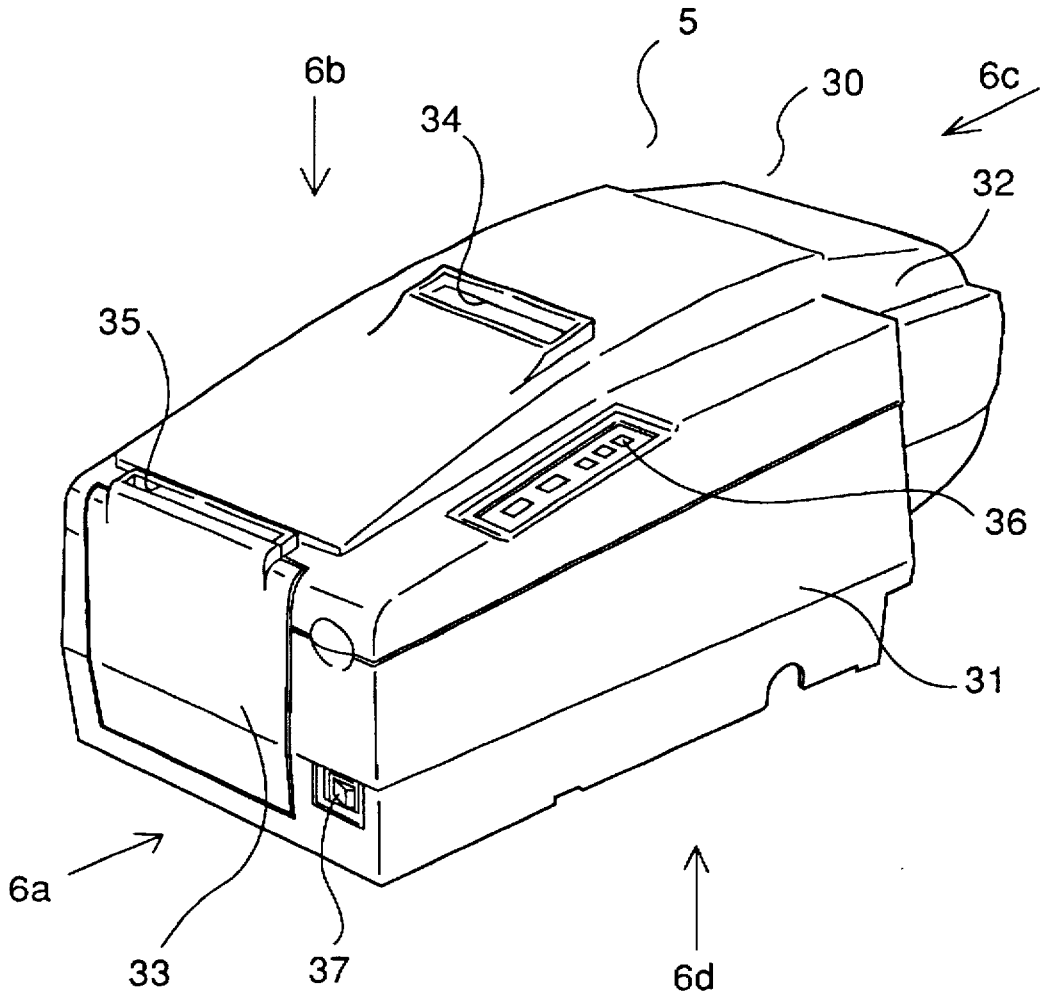
FIG. 1 is an external overview of a printer according to a preferred embodiment of the present invention.
Figure 2:
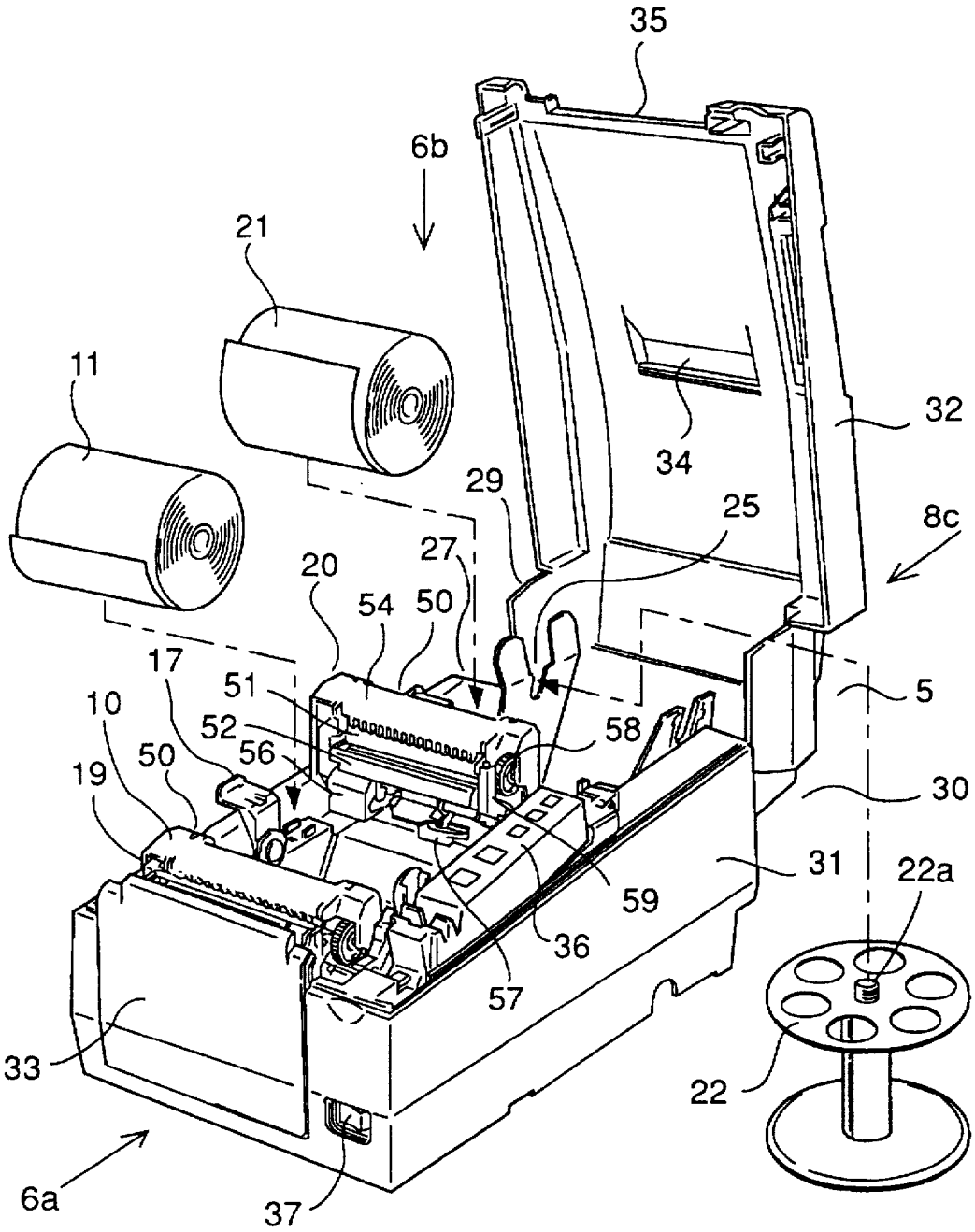
FIG. 2 is an overview of the printer shown in FIG. 1 with the top housing thereof open.

FIG. 1 is an external overview of a printer 5 according to a preferred embodiment of the present invention. FIG. 2 is an overview of the printer 5 with the top housing 32 thereof open, and FIG. 3 is a side cross sectional view of the printer 5.

As shown in the figures, the printer 5 according to the present embodiment has a rectangular parallelepiped shape that is long from the front 6*a* to the back 6*c* with the overall unit enclosed in a housing 30 made of plastic. This housing 30 comprises a bottom housing 31 for housing the various mechanisms of the printer 5, a top housing 32 that is openable on and upward from the bottom housing 6*d* toward top 6*b* of printer 5, and a housing front 33 that is openable toward the front 6*a* of printer 5. A monitor window 34 enabling the user to confirm the results of journal printing described below, and to correct the journal printing results, is disposed in approximately the center of the top housing 32. When housing front 33 is closed upon bottom housing 31, paper exit 35 is formed by the combination of the front and bottom housings. Note that the printed receipt paper is ejected from the top of housing front 33 through this paper exit 35.

A cut-out opening is also formed in the right side of top housing 32 to expose the operating panel 36 disposed on bottom housing 31. The operating panel 36 and a power switch 37 disposed in the front 6*a* of bottom housing 31 enable manual control of printer 5 according to the present embodiment.

Figure 3:
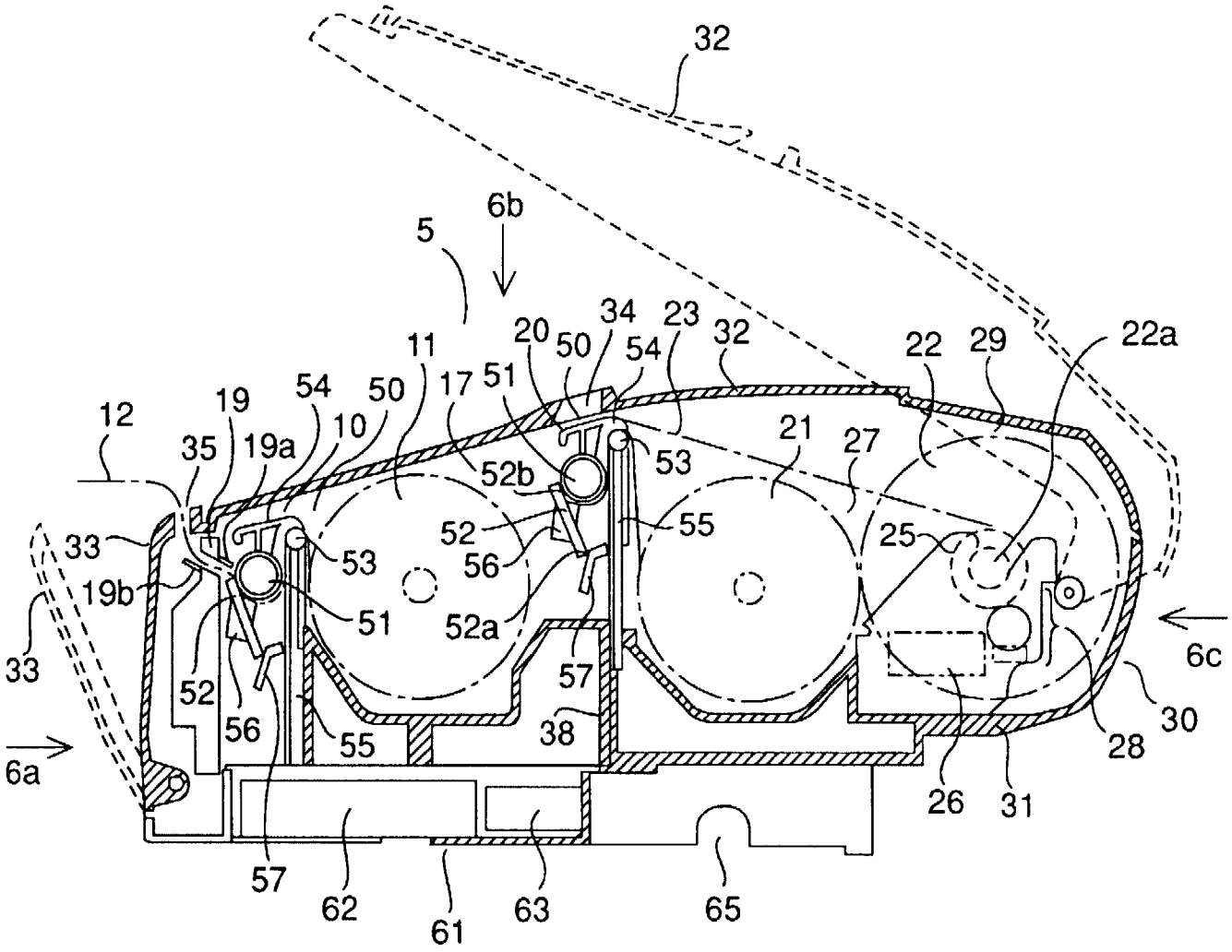
FIG. 3 is a side cross sectional view of the printer shown in FIG. 1.

As shown in FIG. 2 and FIG. 3, printer 5 according to the present embodiment is divided longitudinally into two major sections from front 6*a* to back 6*c*. The front section is the receipt printing section in which are disposed, in sequence from front 6*a*, automatic paper cutter 19 for automatically cutting off the receipt after printing, receipt printing mechanism 10 for printing the receipts, and roll paper housing 17 for storing the roll paper 11 used for receipt printing. The back section is the journal printing section in which are disposed, in sequence from front 6*a*, journal printing mechanism 20 for journal printing, roll paper housing 27 for storing the roll paper 21 used for journal printing, and take-up reel housing 29 for storing the take-up reel 22 onto which the journal roll paper is wound after journal printing.

Identically constructed printing assemblies 50 are used in both receipt printing mechanism 10 and journal printing mechanism 20 of the printer 5 according to the present embodiment. The printing assemblies 50 are relatively flat units comprising a platen roller 51, thermal head frame 52 for pressing a heatsensitive recording paper against platen roller 51 and printing on the recording paper, motor 56 that is connected to platen roller 51 by means of a gear train to rotationally drive platen roller 51 at a predetermined speed, and support base 55 for supporting these components. The support base 55 is mounted substantially perpendicularly to a longitudinal axis of chassis 38 of housing 30.

Knob 58 and release lever 59 are also disposed on the right side of platen roller 51 as seen from front 6*a*, i.e., on the same side as operating panel 36. Knob 58 is used to manually rotate platen roller 51, and release lever 59 is used to release motor 56 and thereby reduce the load when manually turning platen roller 51 using knob 58. More specifically, all operating means used to manually operate printer 5 are concentrated on one side, i.e., the right side in this embodiment, of the printer 5. Operation by the user is therefore facilitated, and the operator can easily operate the printer using one hand.

When the printed roll paper is guided toward the back of the printer, a guide plate 54 for guiding the paper is mounted above platen roller 51. On the edge 52*a* of thermal head frame 52, opposite that which contacts platen roller 51, is fastened a lever 57 for opening the printing section defined by both platen roller 51 and printing part 52*b* of thermal head frame 52. When the lever 57 is rotated, thermal head frame 52 is separated from platen roller 51, thus opening the recording medium path inside printing mechanism 50 wide to the outside. When a paper jam occurs inside printing assembly 50, lever 57 can be operated to open the recording medium path and enable the jammed paper to be easily removed.

Receipt paper 12 is fed by guide roller 53 from roll paper 11 housed in roll paper housing 17, positioned behind receipt printing mechanism 10, to the printing assembly 50 of receipt printing mechanism 10. The receipt paper 12 is then guided to platen roller 51, and advanced by the rotation of platen roller 51 to the printing part 52*b* of thermal head frame 52 for receipt printing. The printed receipt paper 12 is then guided to cutter 19*b* of automatic paper cutter 19 by guide vane 19*a*, which extends from automatic paper cutter 19 positioned at the front of receipt printing mechanism 10 toward platen roller 51. After passing cutter 19*b*, receipt paper 12 is ejected outside printer 5 from paper exit 35 in the front of housing 30.

When printing receipt paper 12 by receipt printing mechanism 10 is completed, receipt paper 12 is thus ejected from printer 5 and automatically cut by cutter 19*b* of automatic paper cutter 19 to form a printed receipt that can be handed to the customer.

Journal paper 23 is similarly supplied by guide roller 53 to platen roller 51 of printing assembly 50 mounted in the journal printing section from roll paper 21 held in journal printing roll paper housing 27 disposed behind the printing assembly 50. The journal paper 23 is likewise advanced by the rotation of platen roller 51 to the printing part 52*b* of thermal head frame 52 for journal printing, and is transported over guide plate 54 to the back of journal printing mechanism 20. The printed journal paper 23 is then taken up on take-up reel 22 disposed in take-up reel housing 29 behind roll paper housing 27.

To drive take-up reel 22 and wind the printed journal paper 23 onto the takeup reel 22, a reel bearing 25 supporting shaft 22*a* of take-up reel 22, motor 26 for rotationally driving take-up reel 22, and power transfer gear train 28 are disposed in take-up reel housing 29.

Monitor window 34, enabling the operator to visually confirm the content printed on journal paper 23 is disposed approximately above guide plate 54 of printing assembly 50 of journal printing mechanism 20. With the guide plate 54 also functioning as a writing pad, monitor window 34 also enables the operator to write on the journal paper to add memos, sign the journal, or correct printing errors.

The printing assembly 50 disposed to the journal printing section of the present embodiment is also fastened to the housing at a position slightly higher than the receipt printing mechanism 10, thereby bringing the journal paper 23 as close as possible to monitor window 34. This improves the visibility of the paper through monitor window 34, and makes it easier to write on the paper.

A printer control circuit board 62 and one or more connectors 63 for sending and receiving data and control signals are disposed in space 61 below receipt printing section and receipt printing roll paper housing 17 in printer 5 according to the present embodiment. All connectors 63 are also oriented facing back 6c of printer 5.

Figure 4:
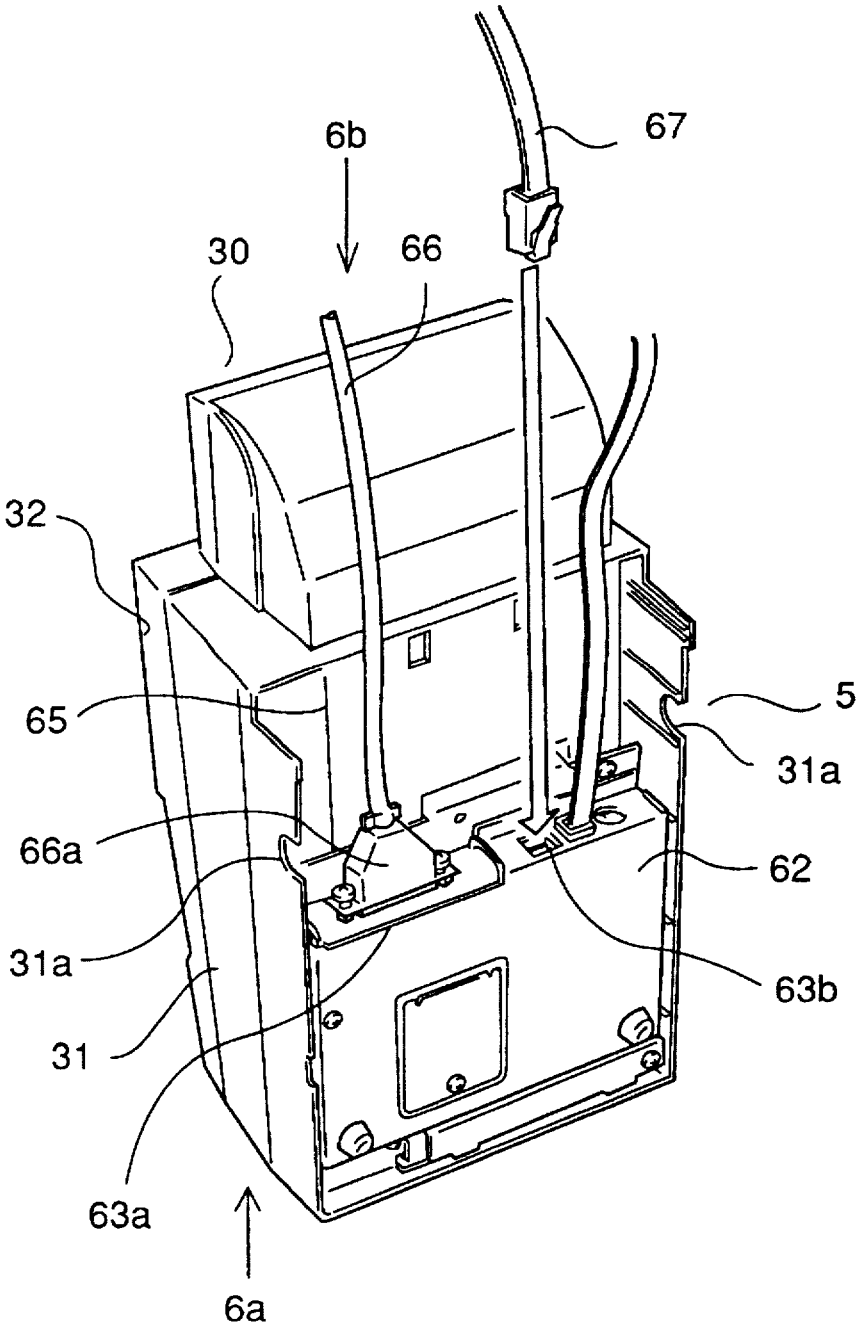
FIG. 4 is a bottom view of the printer shown in FIG. 1.

The side walls only of printer 5 are extended downward below journal printing roll paper housing 27 to create a housing area 65 for any cables. As shown in FIG. 4, print data and control signal cables 66 and 67 can be connected to connectors 63a and 63b using this cable housing area 65. This enables printer 5 according to the present embodiment to be placed tight against a wall or other device without cable connectors 66a protruding from the back of printer 5.

Because the cable connectors are not externally exposed and the cables can be held in housing area 65 and connected without excessively bending the cables, the cables are less likely to disconnect from the printer-side connector jacks, and shorts and other problems arising from tightly bending the cables can be prevented. Note, however, that a cut-out 31a is also provided in the side wall extension of the printer 5 housing so that the interface cables can be led through the side of the printer 5 as may be required by the printer location.

As will be readily appreciated from the above description, receipt printing mechanism 10, receipt printing roll paper housing 17, journal printing mechanism 20, journal printing roll paper housing 27, and printed journal paper take-up reel housing 29 are arranged in-line from the front 6a to the back 6c of printer 5. As a result, a printer 5 equipped with both receipt printing and journal printing capabilities can be provided in a narrow, compact housing while assuring the desirable width in the roll paper used for both printing functions. By also placing the take-up reel housing 29 behind journal printing mechanism 20, the journal printing content can be viewed through monitor window 34, which also enables the operator to write on the journal paper as necessary.

A narrow width printer as described in the present embodiment can also be easily placed beside a personal computer or display on top of a cash drawer to construct a POS station with a small footprint. The long, narrow configuration of the printer 5 of the present invention facilitates placement around the perimeter of the POS station area, and is therefore suited to the efficient assembly of multiple function POS stations for installation in confined areas. With the printer section used to print and output the receipts handed by the operator to the customer located at the front 6a of the printer, the printer of the present embodiment also assures good operability.

The visibility of the journal paper through the monitor window is also improved and the operator can easily write on the printed journal paper because monitor window 34 is disposed above the journal printing mechanism at approximately the center of housing front 33, and the journal printing mechanism is mounted at a position higher than the receipt printing mechanism. The printer of the present invention therefore facilitates the assembly of compact POS stations with an easy-to-use printer.

When top housing 32 of the printer according to the present embodiment is opened, all internal components are readily accessible in a single plane because the receipt printing mechanism 10, receipt printing roll paper housing 17, journal printing mechanism 20, journal printing roll paper housing 27, and printed journal paper take-up reel housing 29 are arranged in-line from the front 6a to the back 6c of printer 5. Access to the receipt printing mechanism 10 of the printer 5 according to the present embodiment is also improved for paper jam removal and regular maintenance because housing front 33 is designed to open forward.

Figure 5:
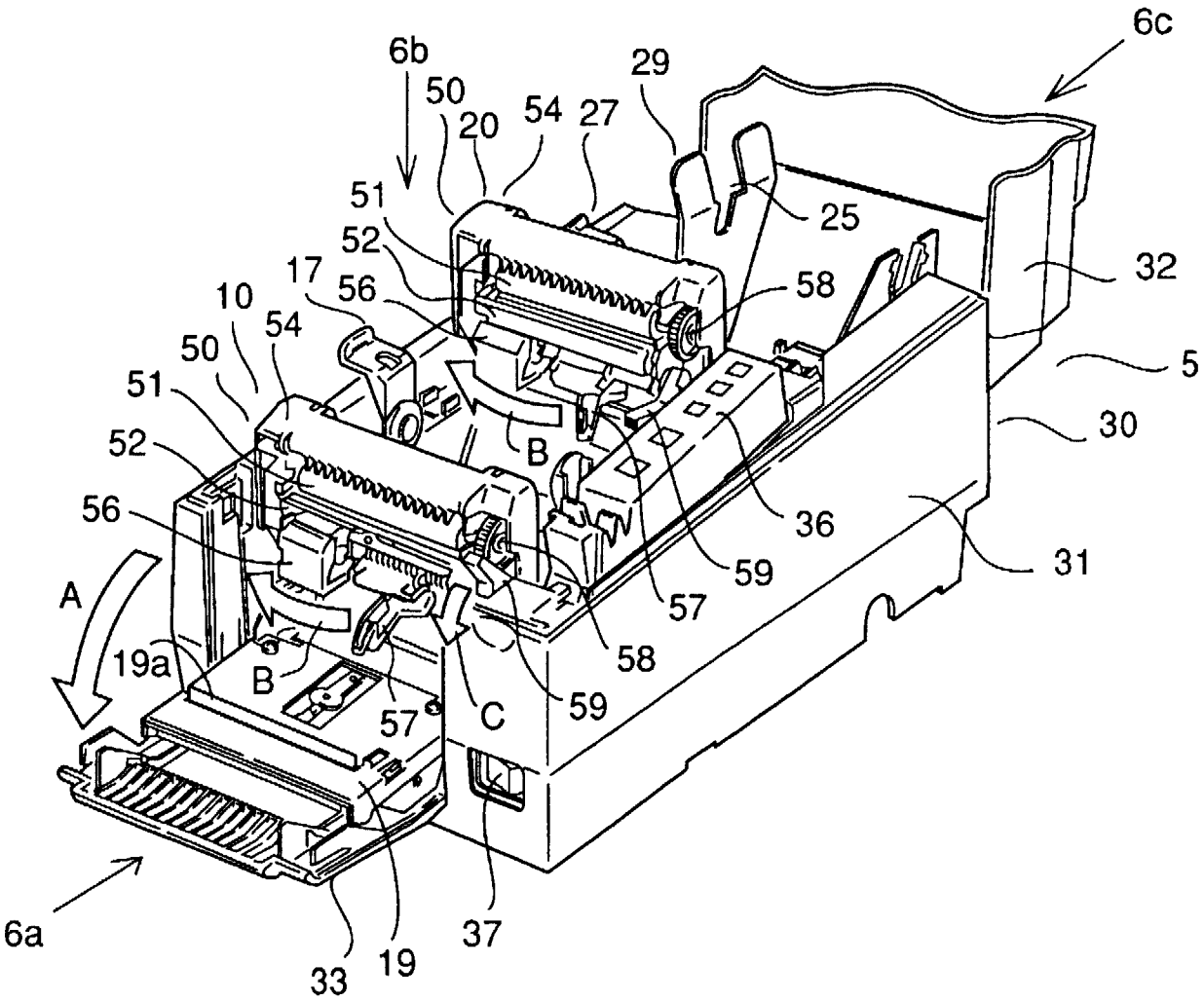
FIG. 5 is an overview of the printer shown in FIG. 1 with the front housing thereof open.

The appearance of printer 5 when the printer is opened to access the inside for paper jam removal, to correct other problems, or for maintenance is shown in FIG. 5.

When top housing 32 is opened upward, each of the major components inside printer 5 can be seen. When housing front 33 is then opened forward, automatic paper cutter 19 is exposed and any paper jams therein can be easily removed. Automatic paper cutter 19 is also fixed to the chassis of printer 5 so that automatic paper cutter 19 can be rotated forward. When automatic paper cutter 19 is thus rotated forward in the direction of arrow A, printing assembly 50 disposed to the receipt printing section is almost completely exposed. When lever 57 of thermal head frame 52 is then turned forward in the direction of arrow B, thermal head frame 52 drops forward to open the recording medium path. Any paper pieces or paper jams between thermal head frame 52 and platen roller 51 can thus be easily removed.

The motor and platen roller 51 are also disengaged by rotating release lever 59 on the right side of platen roller 51 in the direction of arrow C, thereby enabling platen roller 51 to be rotated easily by turning knob 58, which is also on the right side. It is therefore also easy to remove paper jams from the vicinity of platen roller 51.

Because the same printing assembly 50 is used as both receipt printing mechanism 10 and journal printing mechanism 20 in printer 5 according to the present embodiment, paper jams are corrected identically in both printing assemblies 50. All manually operated levers and knobs are also provided on the same side of the printer, i.e., the right side as seen from front 6a in the present embodiment. It is therefore simple for the operator to correct paper jams and similar problems with the printer according to the present embodiment, thereby continuing service without keeping customers waiting.

Figure 6:
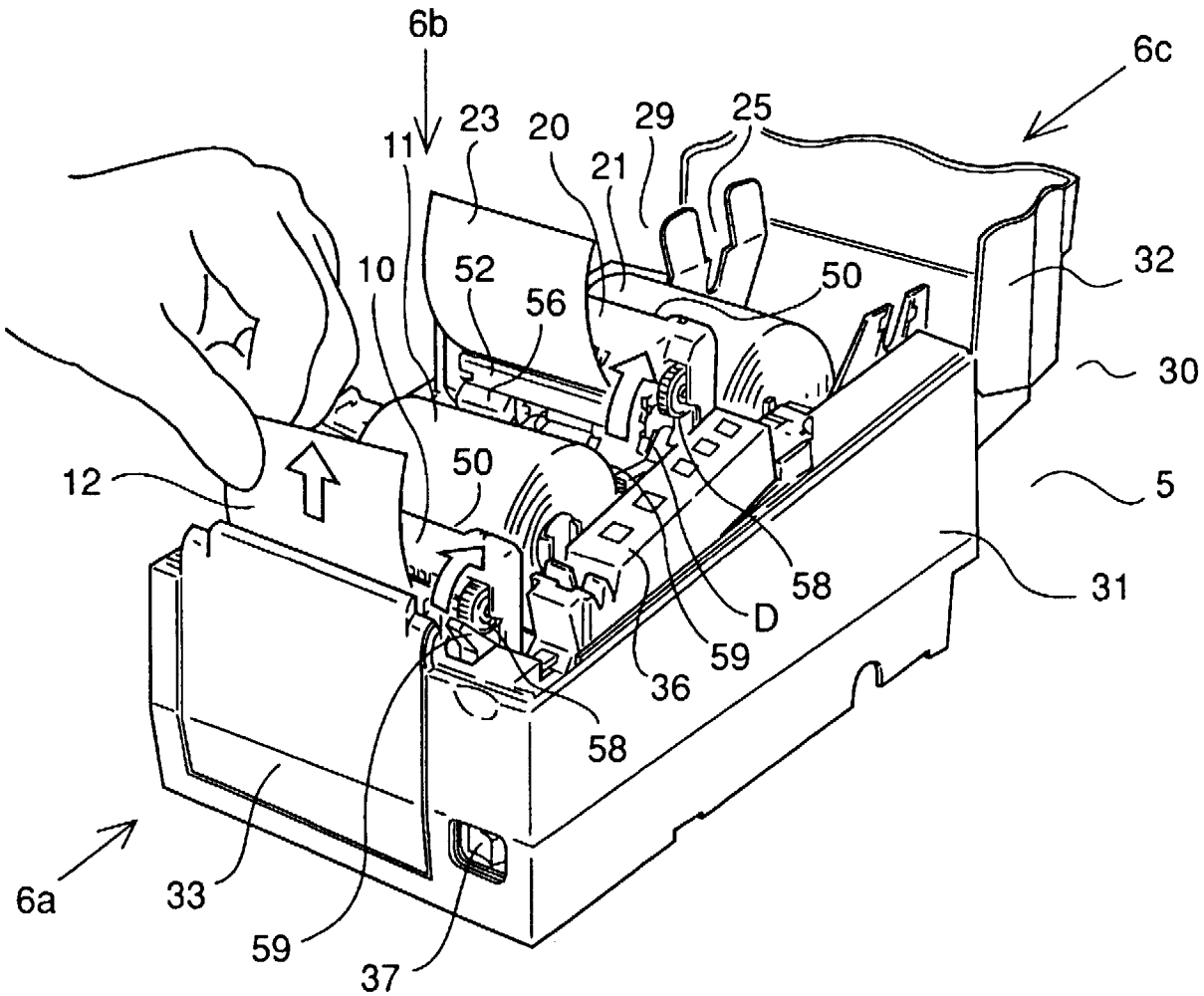
FIG. 6 is an overview of the printer shown in FIG. 1 used to describe the operation whereby paper is loaded to the printer.
Figure 7:
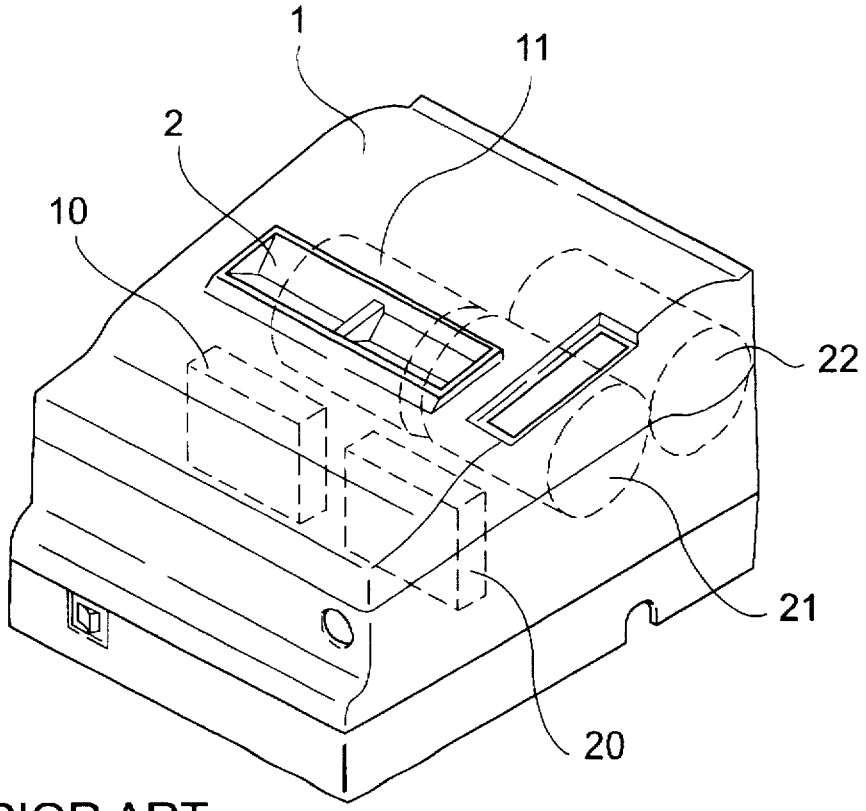
PRIOR ART FIG. 7
FIG. 7 is an overview of a conventional printer in which the receipt and journal printing mechanisms are disposed side by side.

When the paper supply is depleted it is also simple to set a new paper roll in receipt printing mechanism 10 and journal printing mechanism 20. This is shown in FIG. 6 and described below.

The first step is to open top housing 32, and then set roll paper 11 or 21 in roll paper housing 17 or 27, respectively. Lever 59 on the right side of printing mechanism 50 is then pulled forward to free platen roller 51 from the motor. By then turning knob 58 to manually rotate platen roller 51, receipt paper 12 or journal paper 23 is pulled from roll paper 11 or 21 through the recording medium path to the correct position. The process for setting the printing paper in position is the same for both receipt paper 12 and journal paper 23, and release lever 59 and knob 58 are operated in the same direction for both the receipt printing mechanism 10 and journal printing mechanism 20.

In a conventional printing apparatus in which the receipt and journal printing mechanisms are arranged vertically in-line, problems caused by paper chaff in one printing mechanism can cause problems in the other printing mechanism. With printer 5 according to the present embodiment, however, the longitudinally in-line arrangement of the receipt printing mechanism 10 and journal printing mechanism 20 prevents such problems in one printing mechanism from creating problems in the other printing mechanism, in addition to providing excellent maintenance characteristics. This flat, in-line arrangement of the receipt printing mechanism 10 and journal printing mechanism 20 also enables the printed content to be easily viewed from above the printer.

It should be noted that journal printing roll paper housing 27 and take-up reel housing 29 are also disposed in this same flat, in-line arrangement to reduce the height of printer 5 in the present embodiment. Roll paper 21 and take-up reel 22 housed respectively in roll paper housing 27 and take-up reel housing 29 are, however, replaced at the same time. It is therefore possible to arrange these two housings one above the other. Other than increasing the overall height of printer 5, this arrangement makes it possible to provide a narrow and even shorter printer 5 while having no affect on either the maintenance or operation of printer 5.

It should be further noted that while the present invention has been described using by way of example a printer equipped with both receipt printing and journal printing functions for use as a POS printer, the present invention shall not be limited to application with POS printers. For example, the printer according to the present invention can be applied to a printing apparatus comprising different printing mechanisms, e.g., a thermal printer and a dot matrix impact printer, to reduce the size of the overall printing apparatus while maintaining good maintenance and operation characteristics by arranging the two printing mechanisms and the space in which the corresponding recording media are stored longitudinally in-line.

A narrow, compact printer can also be achieved in printers that use cut-sheet forms instead of roll paper by using the longitudinal in-line arrangement of the present invention.

Furthermore, while the present invention has been described using by way of example a dedicated POS printer, the invention can also be applied to integrated apparatuses combining the functions of a cash drawer, personal computer and display, and printer. By thus arranging the receipt and journal printing mechanisms and the paper rolls therefor in-line, plural printing functions can be compactly provided within the limited space inside such integrated apparatuses while maintaining good maintenance and operation characteristics.

As described above, a printing apparatus according to the present invention disposes a first printing mechanism and the first recording media storage section therefor in line with a second printing mechanism and a second recording media storage section therefor to provide both receipt printing and journal printing capabilities, thereby achieving a compact, narrow printing apparatus having two different printing functions. Furthermore, because the first printing mechanism and the first recording media storage section therefor is in line with a second printing mechanism and a second recording media storage section therefor, the printing mechanisms are compactly arranged on a single plane, and the maintenance and operating characteristics of both printing mechanisms are excellent.

The narrow, compact printing apparatus according to the present invention is suited to installation in confined spaces in combination with a personal computer, cash drawer, display, or other devices, and is thus well suited to assembling compact, multiple function POS stations.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printing apparatus for printing on first and second recording media comprising:

a main housing having a longitudinal dimension;

first and second printing mechanisms, disposed longitudinally in-line in said main housing, for respectively printing on said first and second recording media;

a first recording medium housing for storing the first recording medium, a second recording medium housing for storing the second recording medium, and a third recording medium housing for storing the first recording medium printed by said first printing mechanism, said first, second and third recording medium housings disposed in said main housing longitudinally in-line with said first and second printing mechanisms;

a recording medium path in said main housing, traveled by said first recording medium, for connecting said first printing mechanism and said third recording medium housing; and a window in said main housing disposed above said recording medium path for visually exposing said first recording medium to an outside of said main housing when said first recording medium occupies said recording medium path.

2. A printing apparatus according to claim 1, wherein at least one of the first and second recording media is a roll paper medium, and wherein one of the first and second recording medium housings for storing at least one of said roll paper media is disposed substantially in-line between the first and second printing mechanisms.

3. A printing apparatus according to claim 2, wherein the first printing mechanism comprises:

a printing section comprising:

a print head; and a platen opposing said print head with the first recording medium disposed therebetween; and a printing section opening mechanism for opening and closing said printing section by moving at least one of the print head and platen relative to the other; and wherein said roll paper medium is disposable between said first and second printing mechanisms and said printing section opening mechanism is operable when said roll paper medium disposable between said first and second printing mechanisms is removed.

4. A printing apparatus according to claim 1, wherein the first recording medium is a roll paper medium.

5. A printing apparatus according to claim 4, wherein:

the second recording medium is a roll paper medium;

and wherein at least one of the first recording medium housing and the second recording medium housing is disposed between the first and second printing mechanisms.

6. A printing apparatus according to claim 1, further comprising:

a first cover disposed on said main housing such that when said first cover is open at least the first, second and third recording medium housings, the first and second printing mechanisms and the recording medium path are exposed.

7. A printing apparatus according to claim 6, wherein said window for visually exposing the first recording medium is disposed in said first cover.

8. A printing apparatus according to claim 6, wherein said second recording medium is a roll paper medium, and said printing apparatus further comprises:

a cutter disposed in said main housing for cutting said second recording medium; and a second cover disposed on a front of said main housing such that when said second cover is open said cutter is exposed.

9. A printing apparatus according to claim 8, wherein said second recording medium housing is disposed substantially in-line between the first and second printing mechanisms.

10. A printing apparatus according to claim 8, wherein the second printing mechanism is disposed behind said cutter, and wherein said cutter is disposed so as to open to expose the second printing mechanism when said second cover is open.

11. A printing apparatus according to claim 10, wherein said second printing mechanism comprises:

a printing section comprising:

a print head; and a platen opposing said print head with the second recording medium disposed therebetween; and a printing section opening mechanism for opening and closing the printing section by moving at least one of the print head and platen relative to the other; and wherein said cutter is disposed in front of said printing section opening mechanism and said printing section opening mechanism is operable when said cutter is open and said second printing mechanism is exposed.

12. A printing apparatus according to claim 1, wherein said first and second printing mechanisms each comprise:

a base frame;

a print head supported on said base frame;

a platen supported on said base frame opposing said print head with the recording medium disposed therebetween; and a transport mechanism supported on said base frame for transporting the recording medium past the print head; and wherein said first and second printing mechanisms are arranged in said main housing with said base frames maintained substantially perpendicular to a longitudinal axis of said main housing.

13. A printing apparatus according to claim 12, wherein the first printing mechanism is disposed at a position higher than the second printing mechanism.

14. A printing apparatus according to claim 13, wherein the first and second printing mechanisms comprise interchangeable parts.

* * * * *